US006769410B2

(12) United States Patent
Lee et al.

(10) Patent No.: US 6,769,410 B2
(45) Date of Patent: Aug. 3, 2004

(54) INTEGRATED FUEL MODULE WIRE HARNESS AND CARRIER GASKET FOR VEHICLE INTAKE MANIFOLD

(75) Inventors: Ki-Ho Lee, Windsor (CA); James K. Vanderveen, Blehelm (CA); Jeffrey J. Powell, Belleriver (CA); Lisa Whaley, Wheatley (CA)

(73) Assignee: Siemens VDO Automotive Inc., Chatham, CA (US)

( * ) Notice: Subject to any disclaimer, the term of this patent is extended or adjusted under 35 U.S.C. 154(b) by 0 days.

(21) Appl. No.: 10/436,689

(22) Filed: May 13, 2003

(65) Prior Publication Data

US 2003/0230285 A1 Dec. 18, 2003

Related U.S. Application Data

(60) Provisional application No. 60/389,582, filed on Jun. 18, 2002, provisional application No. 60/389,595, filed on Jun. 18, 2002, and provisional application No. 60/389,824, filed on Jun. 19, 2002.

(51) Int. Cl.[7] ..... F02M 61/14; F02M 35/10

(52) U.S. Cl. ..... 123/470; 123/184.61

(58) Field of Search ..... 123/470, 456, 123/468, 184.61

(56) References Cited

U.S. PATENT DOCUMENTS

| | | | | | |
|---|---|---|---|---|---|
| 4,570,601 | A | * | 2/1986 | Ito et al. | 123/468 |
| 5,127,382 | A | * | 7/1992 | Imoehl | 123/470 |
| 5,261,375 | A | * | 11/1993 | Rush et al. | 123/470 |
| 5,598,824 | A | * | 2/1997 | Treusch et al. | 123/470 |
| 5,718,206 | A | * | 2/1998 | Sawada et al. | 123/470 |
| 6,186,106 | B1 | * | 2/2001 | Glovatsky et al. | 123/143 C |
| 6,308,686 | B1 | * | 10/2001 | Mammarella et al. | 123/470 |
| 6,497,218 | B2 | * | 12/2002 | Warner et al. | 123/468 |
| 2004/0000290 | A1 | * | 1/2004 | Lee et al. | 123/456 |

* cited by examiner

*Primary Examiner*—Weilun Lo

(57) ABSTRACT

A fuel module carrier assembly mounted between an intake manifold and an internal combustion engine includes an electrical lead, coil assemblies, fuel modules, fuel module seals, a molded carrier and runner seals. The fuel module carrier assembly retains and protects the electric fuel module components.

16 Claims, 6 Drawing Sheets

INTEGRATED FUEL MODULE WIRE HARNESS AND CARRIER GASKET FOR VEHICLE INTAKE MANIFOLD

The present application claims priority to U.S. Provisional Patent Application Serial Nos. 60/389,582 and 60/389,595, both filed Jun. 18, 2002 and U.S. Provisional Patent Application Serial No. 60/389,824 filed Jun. 19, 2002.

BACKGROUND OF THE INVENTION

The present invention relates to a non-metallic vehicle air intake manifold and, more particularly, to an intake manifold which integrates the fuel modules into a carrier gasket therefor.

An air intake manifold distributes air to a vehicle engine's cylinders. The manifold is located on the engine in the engine compartment of a vehicle. The manifold is in close proximity to various electrical components of the vehicle engine such as fuel injectors, electric throttle body, throttle position sensors, idle air controller, and air temperature and pressure sensors.

Conventional wire harnesses are typically utilized to conduct electricity to the electrical components. The wire harnesses are expensive to manufacture and assemble onto the vehicle engine. Wire harnesses may also be bulky and subject to damage from the hostile environment within the vehicle engine compartment.

Recently, due to the increased use of plastic in the manufacture of air intake manifolds and their proximity to the electrical components, manufacturers have attempted to integrate the wires directly into the plastic air intake manifold. The wire harness itself is embedded into the manifold during the molding process. While the plastic of the manifold protects the wiring from the engine compartment's hostile environment and provides support for the harness, the result may be undesirable in several respects. In particular, it may be difficult to control the exact location of the wiring while molding the rather complicated manifold which may damage the wire harness. Scrap rates may thereby increase resulting in greater expense and lower production volume.

Moreover, as the manifold utilizes a relatively large quantity of material, recycling may be economically feasible. If the manifold is recycled, the wiring within the manifold must be removed prior to reclaiming the plastic. However, recycling is complicated due to the embedded wire harness. This not only increases the expense of producing such a manifold but also makes recycling old manifolds cost prohibitive.

Accordingly, it is desirable to provide an air intake manifold with an integrated wiring system but without the heretofore production difficulties.

SUMMARY OF THE INVENTION

The intake manifold according to the present invention provides a fuel module carrier assembly mounted between an intake manifold and an internal combustion engine. The fuel module carrier assembly includes an electrical lead, coil assemblies, fuel modules, fuel module seals, a molded carrier and runner seals. When assembled, the fuel module carrier assembly retains and protects the electrical fuel module components.

The electrical lead is molded or assembled into the carrier such that the manifold is separate from any metallic or wire components which heretofore were molded directly therein. Assembly, repair, and recycling are greatly simplified as the carrier is formed separate from the manifold.

In one carrier assembly, the fuel modules are inserted into the carrier from the engine side such that only a single fuel module seal is required for each fuel module. Each fuel module is received within a respective fuel module opening and is surrounded by a coil assembly which receives power and communicates through the electrical lead. The fuel module opening is a generally tubular member within which the fuel module closely fits.

Another carrier assembly designed according to the present invention retains or is overmolded with an electrical lead and coil assemblies. The fuel modules are plugged into fuel module openings from the side opposite the engine. The fuel modules may therefore be assembled independent of the carrier assembly which provides numerous assembly possibilities.

Another carrier assembly designed according to the present invention includes an electrical lead having a plurality of connectors. Each connector receives a fuel module assembly having a fuel module and a mating module connector. The fuel module assembly includes an integral coil assembly which communicates through the connector. The module connector is angled relative and offset from the fuel module according to packaging and layout requirements of the manifold.

The present invention therefore provides an air intake manifold with an integrated wiring system but without the heretofore production difficulties.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
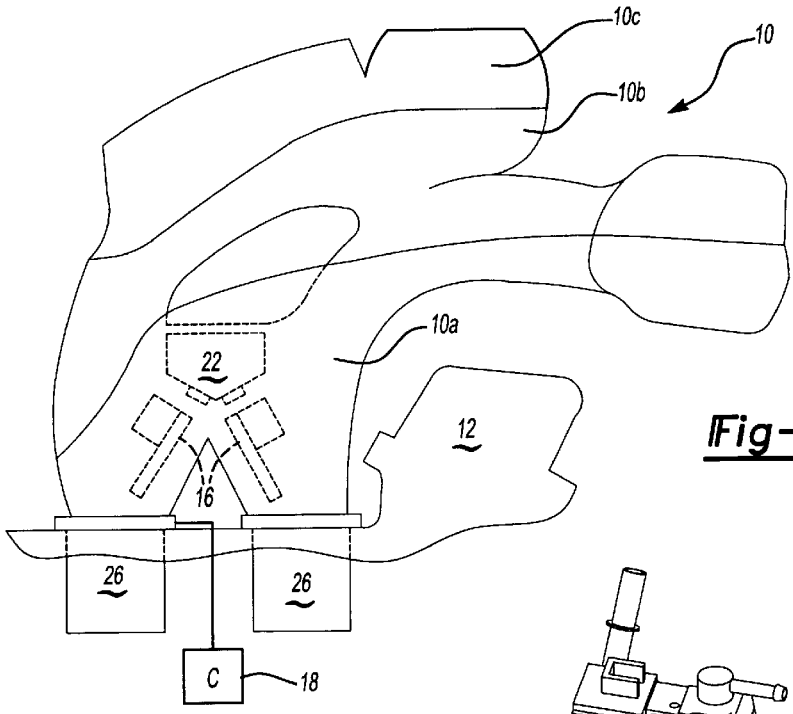
FIG. 1A is a general perspective view an intake manifold for use with the present invention.

FIG. 1A illustrates a general perspective view of an intake manifold 10 mounted to an internal combustion engine 12 to provide for regulation of an air fuel mixture. The manifold is preferably a non-metallic molded plastic manifold which is manufactured of a plurality of sections 10*a*, 10*b*, 10*c* as known but may alternatively or additionally include other molded components which are located adjacent the engine 12.

A plurality of electrical devices such as fuel injectors 16 are disposed within or near the intake manifold 10. The fuel injectors 16 regulate the amount of fuel mixed with air drawn through the intake manifold 10 and into the engine 12. The fuel injectors 16 communicate with a controller 18 (illustrated schematically) which controls and monitors the engine 12 as generally known. It should be understood that the present invention is applicable to other electrical devices which may also include sensors such as any type known in the art including, but not limited to, a throttle position sensor, a knock sensor, an engine temperature sensor, and an EGR valve which are commonly located adjacent an intake manifold. The operational details of these devices are as known in the art and form no part in this invention.

Figure 1B:
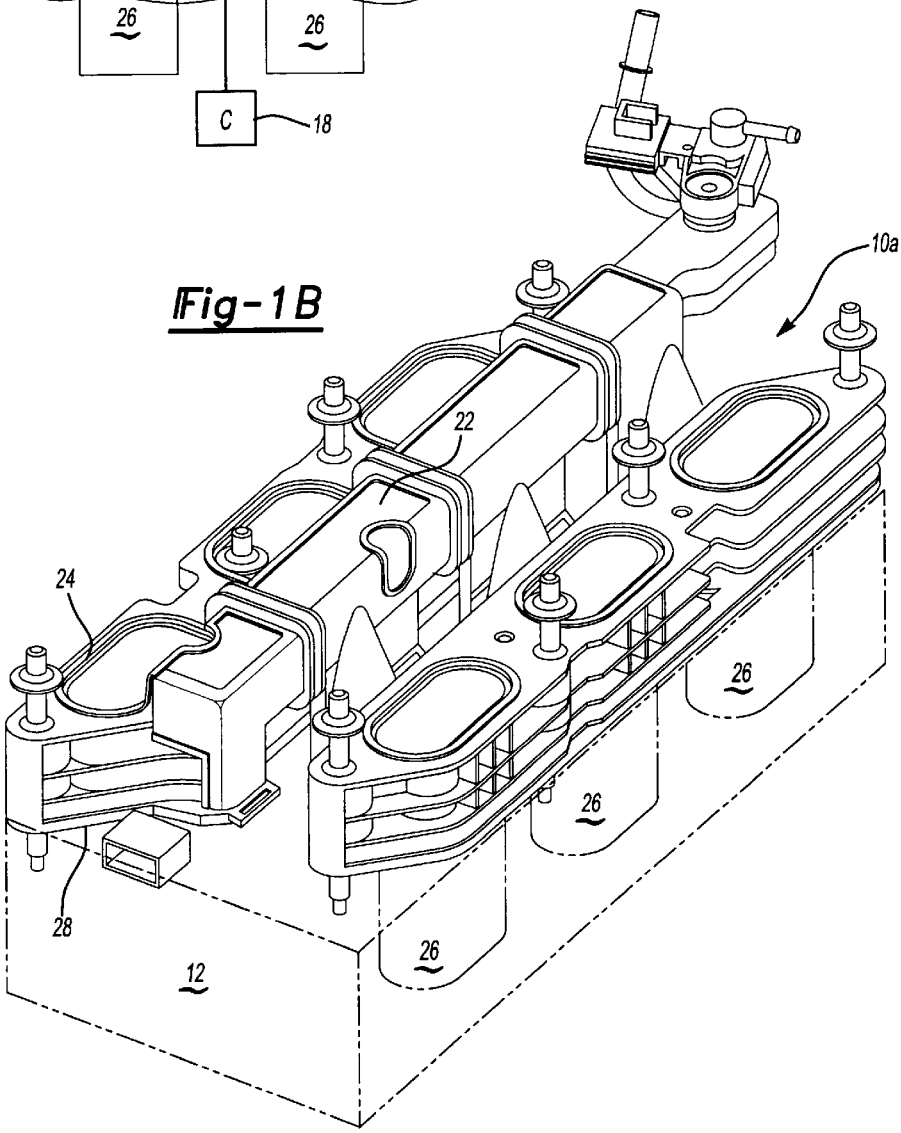
FIG. 1B is a general perspective view of a lower manifold portion of the intake manifold of FIG. 1A.
Figure 2:
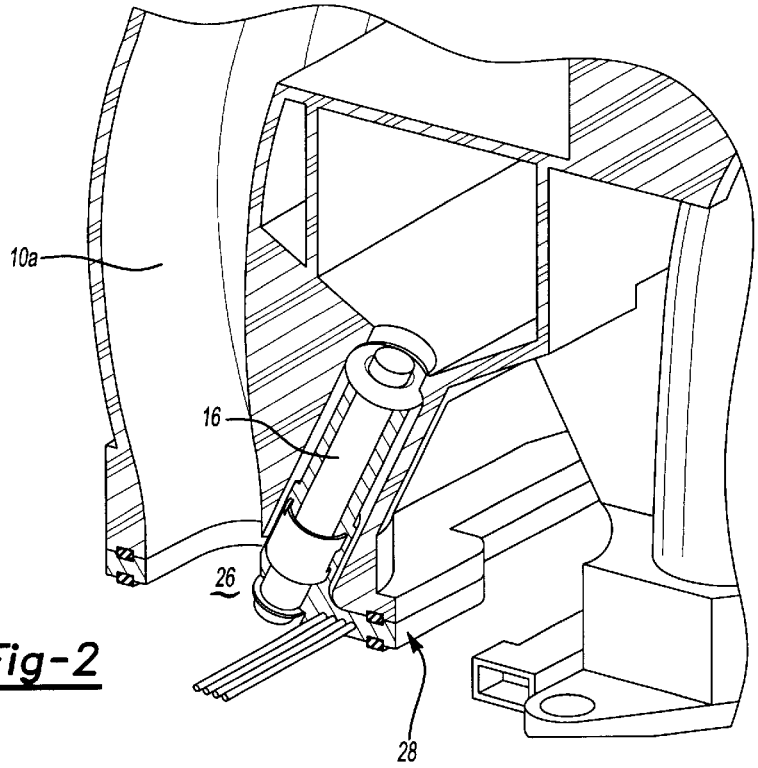
FIG. 2 is a sectional view of a lower manifold portion showing a fuel module communicating with a fuel rail.

Referring to FIG. 1B, the lower manifold portion 10*a* is illustrated. The lower manifold assembly is defined as a "lower" assembly because it is a portion of the intake manifold which is closest to the engine 12. It should be understood that relative positional terms such as "forward," "aft," "upper," "lower," "above," "below," and the like are with reference to the normal operational attitude of the vehicle and should not be considered otherwise limiting. The lower manifold assembly 20 includes a fuel rail 22 which is preferably directly molded thereto. The fuel rail 22 communicates with a plurality of runners 24. Bach runner 24 communicate the air fuel mixture to each engine cylinder 26 (FIG. 2) within the engine 12. A fuel module carrier assembly 28 is preferably mounted between the lower manifold assembly 10*a* and the engine 12.

Figure 3:
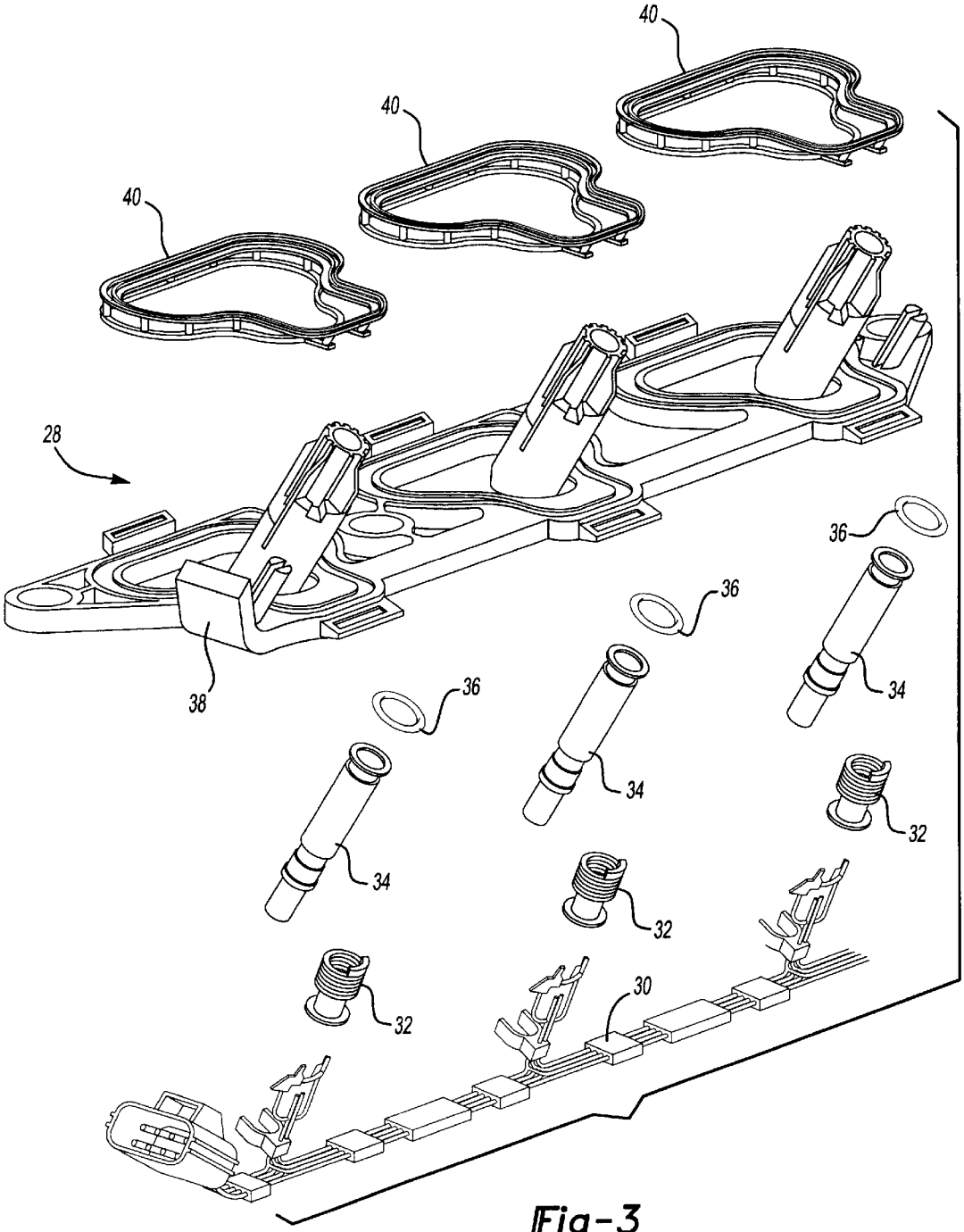
FIG. 3 is an exploded view of a fuel module carrier assembly.

Referring to FIG. 3, the fuel module carrier assembly 28 includes an electrical lead 30, coil assemblies 32, fuel modules 34, fuel module seals 36, a molded carrier 38 and runner seals 40. When assembled, the fuel module carrier assembly 28 retains and protects the electrical components.

The electrical lead 30 is molded or assembled into the carrier 38 such that the manifold 10 is separate from any metallic or wire components which heretofore were molded directly therein. Assembly, repair, and recycling are greatly simplified as the carrier 38 is formed separate from the manifold 10. The carrier 38 may also be manufactured of a material different from the manifold 10 to provide a thermal barrier which may further minimize the material cost of the manifold 10.

Figure 4:
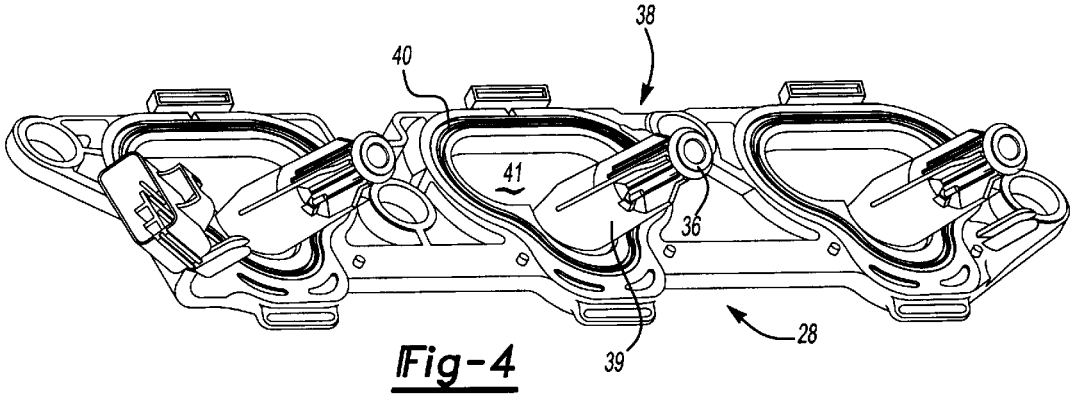
FIG. 4 is a perspective view of a fuel module carrier assembly.
Figure 5:
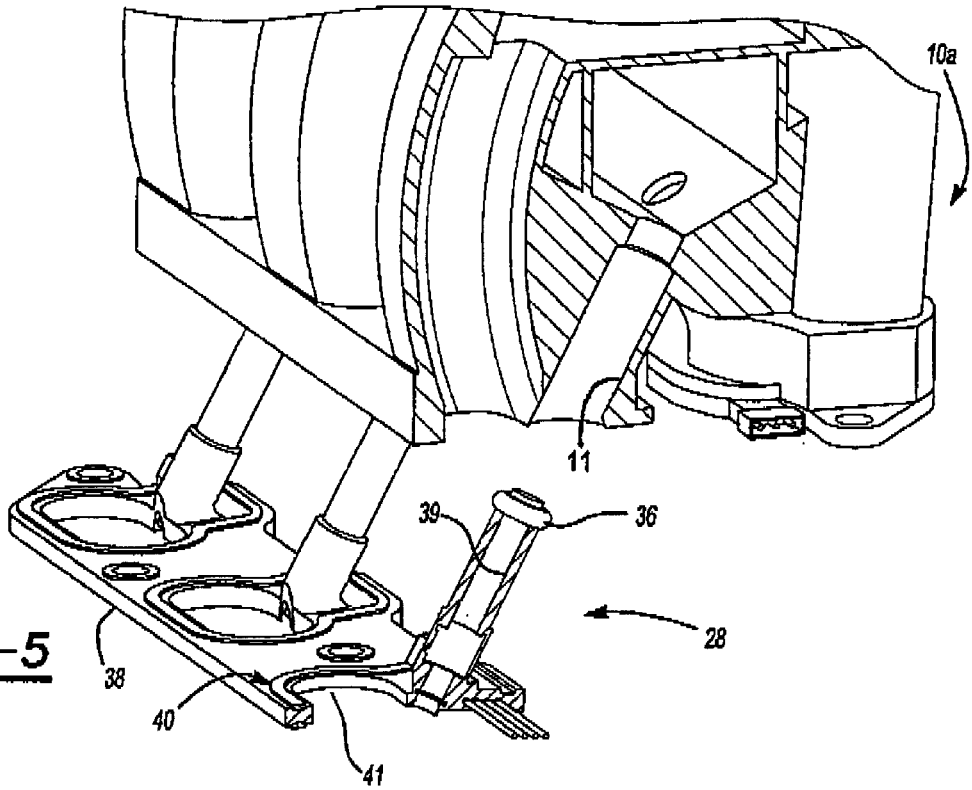
FIG. 5 is a perspective view of a fuel module carrier assembly being inserted into an intake manifold.

The fuel modules 34 are preferably inserted into the carrier 38 from the lower or engine 12 side such that only a single fuel module seal 36 is required for each fuel module 34 (FIG. 4). That is, the fuel module seal 36 is located adjacent the fuel rail 22 such that a fuel rail leak is isolated away from the cylinder 26 (FIG. 5). It should be understood that various locations for seal 36 will benefit from the present invention, including mounting to the carrier 38 or directly to the fuel module 34.

Referring to FIG. 5, each fuel module 34 is contained within a respective fuel module holder 39 formed on the carrier 38. Each of the fuel module holder 39 is fitted into the module cylinder 11 in the lower manifold portion 10*a*. The fuel module holder 39 is preferably a generally tubular member in which the fuel module 34 closely fits. Each fuel module holder 39 is located adjacent a respective runner opening 41 which is located between each runner 24 and each cylinder 26 to allow communication of the fuel air mixture to flow therethrough. The runner seals 40 are located about the runner openings 41 to seal each runner 24 to each cylinder 26 and to the adjacent intake portion.

Figure 6A:
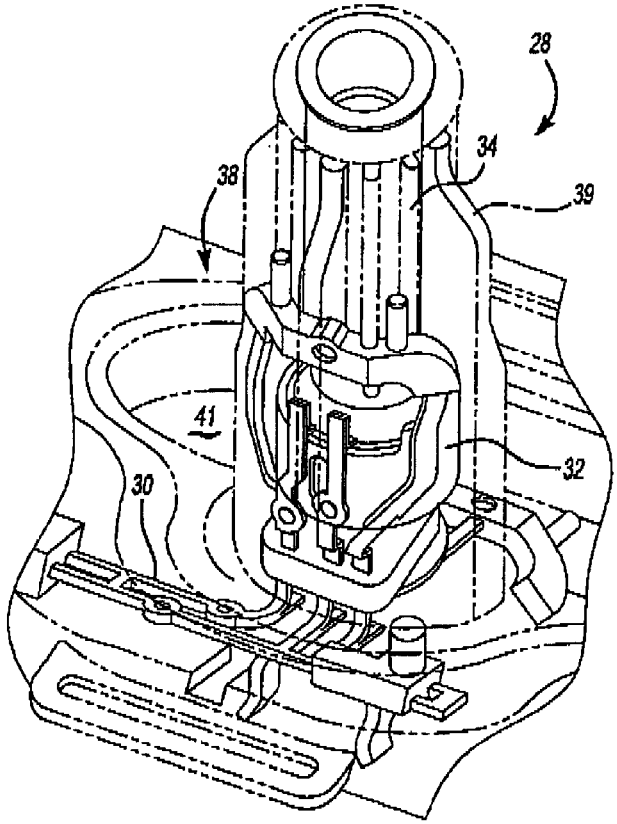
FIG. 6A is a partial phantom view of a fuel module within a fuel module carrier assembly.
Figure 6B:
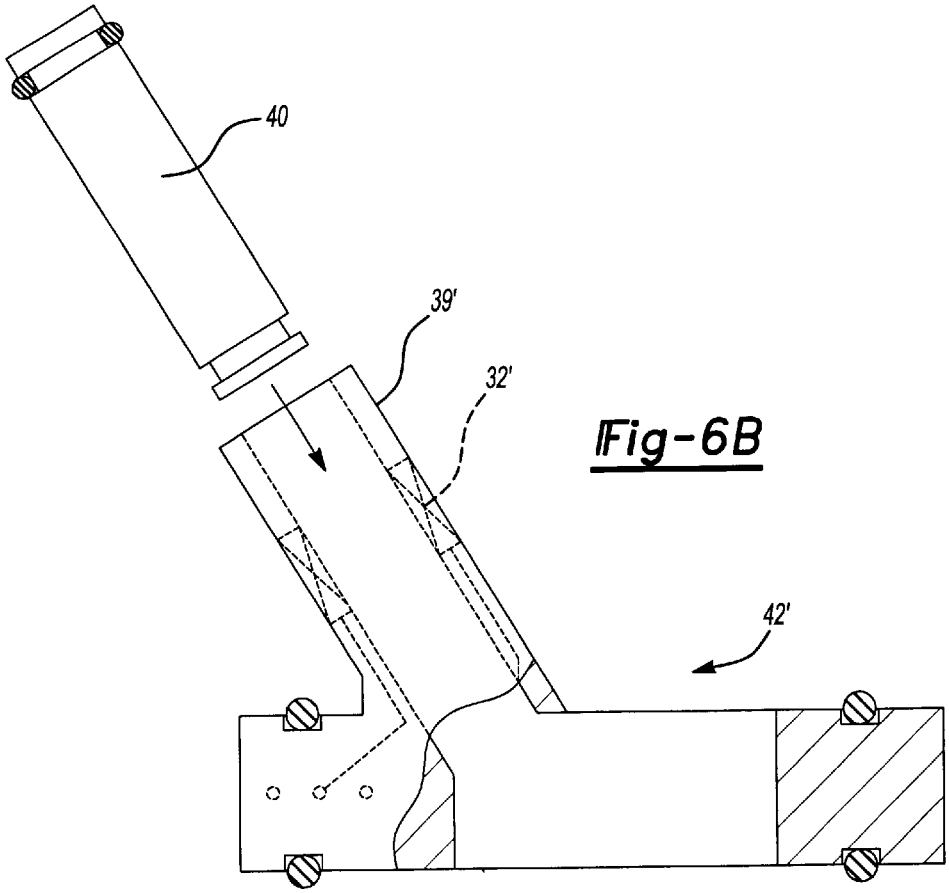
FIG. 6B is a sectional view of another fuel module within a fuel module carrier assembly having an integrally molded coil assembly.
Figure 7:
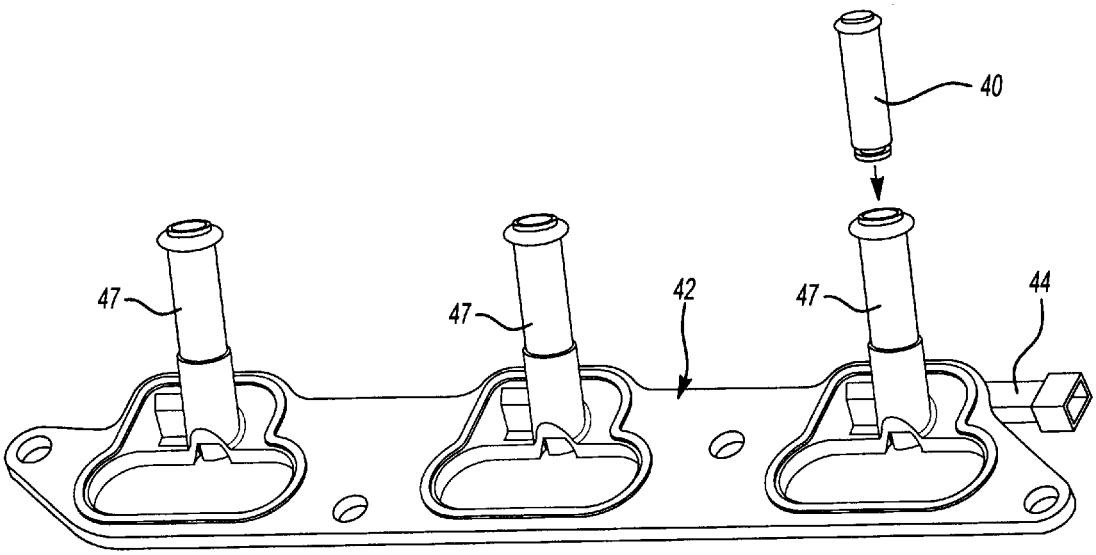
FIG. 7 is a perspective view of another fuel module carrier assembly.

Referring to FIG. 6, each fuel module 34 is received within a respective fuel module holder 39 and is surrounded by a coil assembly 32 which receives power and communicates through the electrical lead 30. It should be understood that at least one fuel module 34 is utilized for each cylinder. Preferably, the fuel module holder 39 retains the coil assembly 32 which plugs into the electrical lead 30. The coil assembly 32' may alternatively be formed directly into the fuel module holder 39' (FIG. 6B). The fuel module 34 plugs into the coil assembly 32 such that an electrical current applied to the electrical lead 30 energies each of the coil assemblies 32 and actuates each fuel module 34 located therein Referring to FIG. 7, a fuel module 40 is mounted into another carrier assembly 42 which retains or is overmolded with an electrical lead 44 and coil assemblies 47 which receive power and communicates through the electrical lead 44. The fuel modules 40 are plugged into fuel module holders 39 which extend from the carrier 42 and each contain a coil assembly 47. That is, the fuel modules 40 are inserted from the side opposite the engine cylinders 26 and are plugged into the coil assemblies 47. The fuel modules 40 may therefore be assembled independent of the carrier assembly 42 which provides alternative assembly possibilities.

Figure 8:
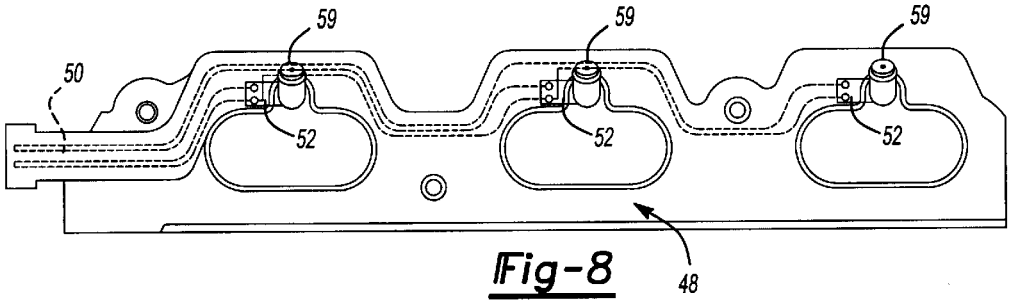
FIG. 8 is a plan phantom view of another fuel module carrier assembly.
Figure 9:
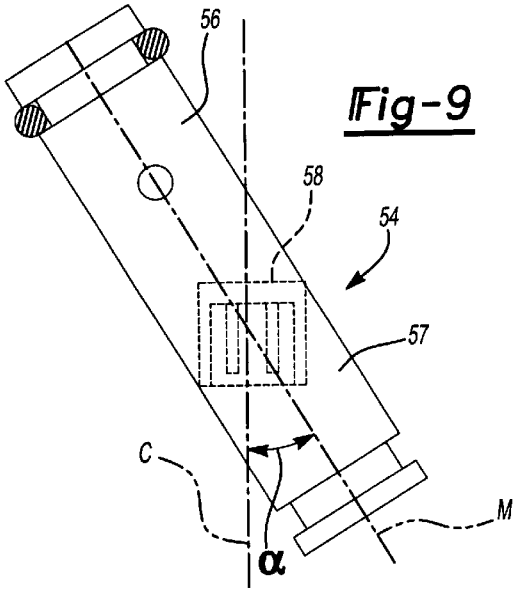
FIG. 9 is a perspective view of a fuel module.

Referring to FIG. 8, another carrier assembly 48 includes an electrical lead 50 having a plurality of connectors 52 each of which receives a fuel module assembly 54 having a fuel module 56 and a mating module connector 58 (FIG. 9). That is, the fuel module assembly 54 includes an integral coil assembly 59 which communicates through the connector 58. The module connector 58 is preferably angled relative the fuel module 56 and offset to the fuel module 56 according to packaging and layout requirements of the manifold 10. That is, the module connector 58 defines a connector axis C and the fuel module 56 defines a fuel module axis M which is laterally offset and angled relative to each other.

Figure 10:
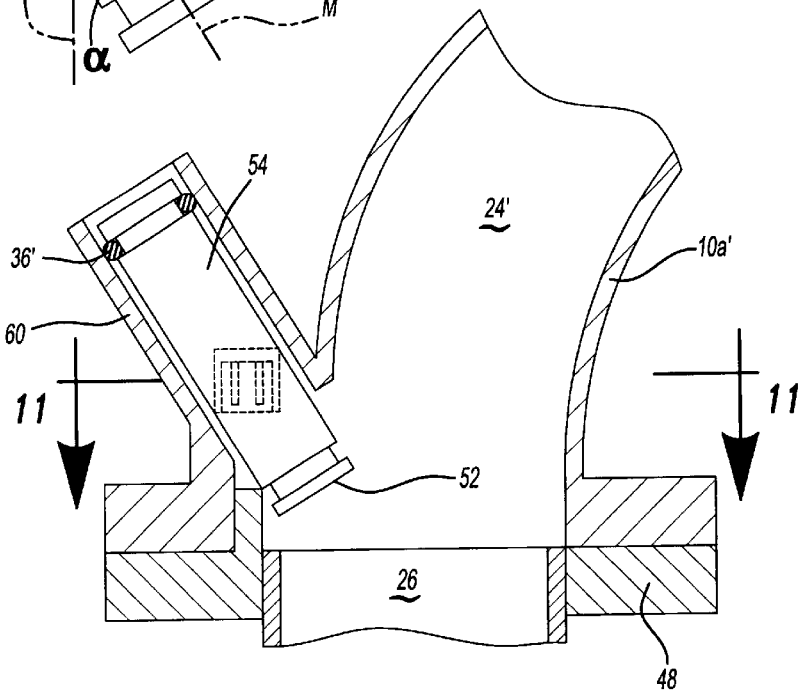
FIG. 10 is a side sectional view of the fuel module of FIG. 9 in a mounted position.
Figure 11:
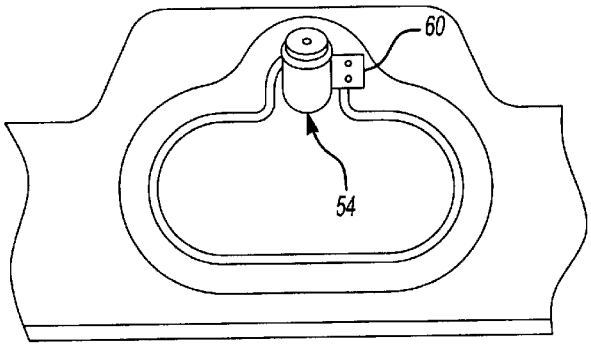
FIG. 11 is a top view of the fuel module of FIG. 9 in a mounted position.

Referring to FIG. 10, a lower manifold portion 10*a*' preferably includes a module aperture 60 which receives the fuel module assembly 54. The module aperture 60 is located adjacent each runner 24'. The fuel module assembly 54 is inserted into the module aperture 60 such that the module connector 58 plugs into a respective connector 52. The lower manifold assembly 10*a*' is preferably assembled to the carrier assembly 48 such that the fuel module assembly 54 is received within the module aperture 60 (FIG. 11) prior to complete assembly of the lower manifold portion 10*a*'. That is, the manifold assembly 10 is formed of the multiple portions 10*a*, 10*b*, 10*c* (FIG. 14), which provide for installation of the fuel module assembly 54 into the module aperture 60 of the lower manifold portion 10*a*' prior to complete assembly of the manifold assembly 10 which preferably closes the module aperture 60. It should be understood that various seals will also be utilized to seal the fuel module assembly 54 into the module aperture 60 as described above and as known in the art. Preferably, a single fuel module seal 36' is utilized for each fuel module assembly 54.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. An intake manifold comprising:

a carrier located adjacent a runner opening and separate from a fuel rail, said carrier defining a plurality of substantially tubular fuel module holders receivable within a respective plurality of module cylinders defined within said intake manifold; and an electrical lead in communication with said fuel module holders, said electrical lead located at least partially within said carrier.

2. The intake manifold as recited in claim 1, further comprising a coil assembly integral with a fuel module and a module connector in communication with said coil assembly.

3. The intake manifold as recited in claim 1, wherein said fuel module holders communicates with a fuel rail.

4. The intake manifold as recited in claim 1, wherein said fuel module holders communicates with said runner opening.

5. The intake manifold as recited in claim 1, further comprising a coil assembly mounted within said fuel module holders, said coil assembly in communication with said electrical lead.

6. The intake manifold as recited in claim 1, further comprising a coil assembly formed into said fuel module holders, said coil assembly in communication with said electrical lead.

7. The intake manifold as recited in claim 1, further comprising a fuel module received within said fuel module holders.

8. The intake manifold as recited in claim 1, wherein said carrier mounts to a lower intake manifold portion.

9. The intake manifold as recited in claim 1, wherein said carrier mounts between a lower intake manifold portion and an internal combustion engine.

10. The intake manifold as recited in claim 2, wherein said electrical lead is molded into said carrier.

11. The intake manifold as recited in claim 2, wherein said module connector connects to a connector which extends from said electrical lead.

12. The intake manifold as recited in claim 2, wherein said module connector is angled relative said fuel module.

13. A fuel module carrier assembly for mounting to an intake manifold comprising:

a carrier located adjacent a runner opening and separate from a fuel rail, said carrier defining a plurality of substantially tubular fuel module holders receivable within a respective plurality of module cylinders defined within said intake manifold;

an electrical lead in communication with said fuel module opening, said electrical lead located at least partially within said carrier;

a coil assembly in communication with said electrical lead; and a fuel module mounted within said fuel module opening an in communication with said coil assembly.

14. The fuel module carrier assembly as recited in claim 13, wherein said fuel module holders communicates with a fuel rail.

15. The fuel module carrier assembly as recited in claim 13, wherein said electrical lead is molded into said carrier.

16. The fuel module carrier assembly as recited in claim 13, wherein said electrical lead is assembled into said carrier.

* * * * *